US006433743B1

(12) United States Patent
Massey et al.

(10) Patent No.: US 6,433,743 B1
(45) Date of Patent: Aug. 13, 2002

(54) FABRIC ANTENNA

(75) Inventors: Peter J. Massey, Horley; Frances Helene Geesin, Heathfield; Clive R. Van Heerden; Nancy Alice Tilbury, both of London; Philippa Clare Wagner, Thursley, all of (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/718,254

(22) Filed: Nov. 22, 2000

(30) Foreign Application Priority Data

Nov. 26, 1999 (GB) ..... 9927842

(51) Int. Cl.[7] ..... H01Q 1/38
(52) U.S. Cl. ..... 343/700 MS; 343/718
(58) Field of Search ..... 343/700 MS, 718, 343/702; H01Q 1/24, 1/38

(56) References Cited

U.S. PATENT DOCUMENTS

| | | | | |
|---|---|---|---|---|
| 3,329,957 A | * | 7/1967 | Hoynes | 343/718 |
| 5,484,707 A | | 1/1996 | Goldberg et al. | 455/41 |
| 5,771,027 A | | 6/1998 | Marks et al. | 343/912 |
| 5,825,327 A | | 10/1998 | Krasner | 342/357 |
| 5,886,667 A | * | 3/1999 | Bondyopadhayay | 343/718 |

FOREIGN PATENT DOCUMENTS

| | | | |
|---|---|---|---|
| EP | 0274592 A1 | 7/1988 | H01Q/1/08 |
| EP | 0637094 A1 | 2/1995 | H01Q/9/04 |
| GB | 2036447 B | 6/1980 | H01Q/1/12 |

OTHER PUBLICATIONS

Izumi Ishii, "Antenna of Portable Radio Equipment", 3–171904, Japan (Abstract).

* cited by examiner

*Primary Examiner*—Michael C. Wimer
(74) *Attorney, Agent, or Firm*—Gregory L. Thorne

(57) ABSTRACT

A patch antenna (10) for mobile telecommunications use is designed for incorporation into the garment of a wearer, e.g. in a shoulder pad (10) or lapel (30). The antenna comprises first and second (12, 16) spaced layers of electrically conducting fabric with a layer (14) of insulating fabric between, and a connection between the conducting layers. The conducting layers (12, 16) may be a single strip of shaped fabric (A, B, C) folded around the insulating layers. The conducting layers are shaped so that the layer adjacent the wearer is of larger area and is connected as the ground plane of the antenna so as to shield the wearer from the strongest electrical fields. Also, the patch antenna is arranged so that its radiating regions (24, 38) are remote from the user's head.

9 Claims, 3 Drawing Sheets

FABRIC ANTENNA

BACKGROUND OF THE INVENTION

The present invention relates to an improved fabric antenna, especially an antenna for incorporation into a garment.

It is known to provide an antenna in a garment, for example for use in a mobile telecommunications system. One example of this is given in EP-A-0 637 094 to Matsushita which describes an antenna comprising metal antenna elements in the form of conductive plates formed on opposite sides of a dielectric slab; the antenna is intended for mounting on a human shoulder, and the rigidity of the dielectric slab prevents deformation of the antenna. However, the rigidity also results in the antenna being uncomfortable and inconvenient to wear.

It is also known to provide an antenna in the form of an at least partially fabric construction. In U.S. Pat. No. 5,771,027, the conducting fabric for an antenna comprises a grid of electrical conductors woven into the warp of a resin reinforced cloth forming one layer of a multi-layer laminate structure, particularly a polarizing grid integrated into the laminated structure of a reflector of a light-weight parabolic antenna, but such an antenna is not suitable for telecommunications use. This unsuitability is to a certain extent down to the generally bulky size and configuration of a parabolic antenna, but also due to its unsuitability in situations where there is a requirement for an antenna with an omnidirectional capability.

SUMMARY OF THE INVENTION

Accordingly, it is an object of the present invention is to provide a fabric antenna capable of unobtrusive incorporation into a garment and suitable for mobile telecommunications use.

According to the invention there is provided an antenna for mobile telecommunications use characterised by first and second spaced layers of electrically conducting fabric; a layer of electrically insulating fabric between the first and second layers; first connection means by which electrical contact is made between the first and second layers; and second connection means by which the first and second layers are connectable to telecommunications equipment.

In one embodiment, the antenna is incorporated into a shoulder portion of a garment, for example as a shoulder pad. In another embodiment the antenna is incorporated into a lapel of a garment. In both embodiments it is highly preferable that the layer of electrically conducting fabric adjacent a wearer of the garment is of substantially greater area than the other layer of electrically conducting fabric and is connected as a ground plane so that the user is isolated from the strongest electrical fields emitted by the antenna.

In a preferred arrangement the antenna comprises a single piece of electrically conducting fabric folded around the insulating fabric, whereby the fold in the conducting fabric constitutes the first connection means.

By use of the invention as the antenna in mobile telecommunications equipment, the remainder of the handset can be made smaller and lighter than was previously possible through separation of the component parts, particularly as the overall size of many mobile telephone handsets is constrained by the size of the antenna assembly used. Such an antenna is flexible and lightweight and does not impede the movements of the user. The mobile telecommunications equipment may be a mobile telephone or a pager or a wireless Local Area Network (LAN).

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
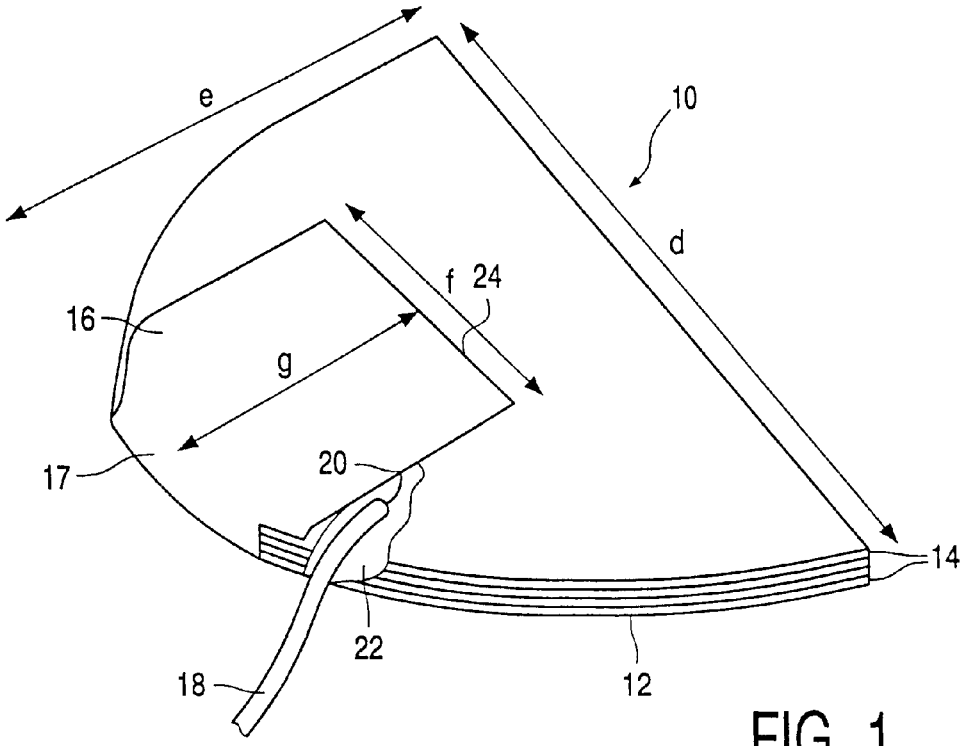
FIG. 1 illustrates a first embodiment of the invention in the form of a shoulder pad antenna.

In FIG. 1, a shoulder pad patch antenna 10 comprises a lower layer 12 of conducting fabric in a "D" shape, a number of layers 14 of insulating fabric of the same size and shape as the lower layer 12, and an upper layer 16 of conducting fabric which is approximately rectangular in shape and substantially smaller than the lower layer 12. The upper and lower layers are connected by a neck 17 of conducting fabric.

A co-axial cable 18 feeds the antenna, the core being connected to the upper layer 16 at 20, and the outer conductor being connected to the lower layer 12 at position 22 where the insulating layers 14 are cut away. The cable 18 is connected to an item of mobile telecommunications equipment (not shown).

The lower layer 12 is to be positioned in a garment so as to be adjacent the wearer. The lower layer 12 is connected as the ground plane of the antenna 10, and the relative shapes of the upper and lower layers 16, 12 are such that the ground plane extends substantially beyond the radiating edge of the upper layer 16, and this isolates the wearer from the strongest electrical fields. In addition, the overall bandwidth of the patch antenna is increased, and the amount of signal absorbed by the wearer is reduced.

It will be understood that the antenna 10 can be flexed in use to fit the shoulder of the wearer and therefore to be comfortable in use, but the antenna will still remain fully operative.

Figure 2:
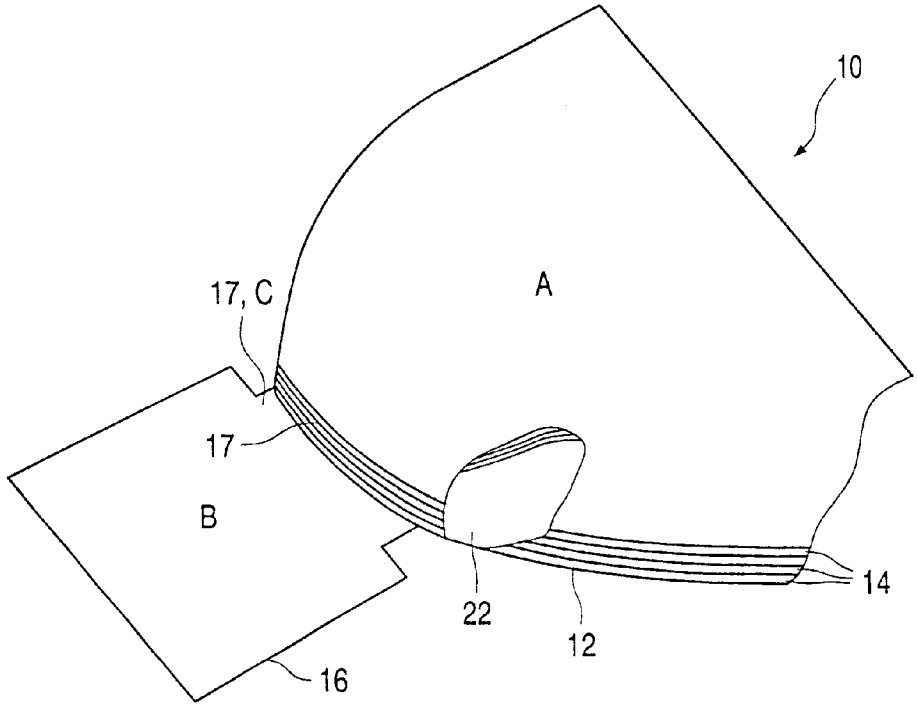
FIG. 2 illustrates the fabric part of the antenna of FIG. 1.

FIG. 2 illustrates the fabric layers before folding into a shoulder pad antenna. The conducting fabric is cut to have a "D" shaped part A and a smaller rectangular part B joined by a short neck C. The insulating layers 14 are also cut to have a "D" shaped part A only, with a cut-out at 22 to allow electrical connection. The rectangular part B of the conducting layer is folded over the insulating layers to form the upper conducting layer 16, and good electrical connection between the upper and lower layers 16, 12 is therefore ensured.

Typically the antenna 10 will be 240 millimeters along its dimension d, and 130 millimeters along dimension e; the upper electrode 16 will have dimensions f and g as shown of 80 millimeters and 72 millimeters respectively. The thickness is typically 10 millimeters. Such an antenna has a 3 dB bandwidth of over 200 MHz and a centre frequency of 925 MHz; it is therefore suitable for use as the antenna of a Global System for Mobile Communications (GSM) telephone and forms a quarter wavelength patch resonator.

A suitable conducting fabric is a woven nylon plated with a layer of copper or silver or nickel; the fabric known as "Shieldex" (Trade Mark) is suitable. For the insulating layers, typical garment and/or shoulder pad materials are suitable, such as acrylic, horse hair, cotton, polyester, wool and tailor's foam.

It will be seen from FIG. 1 that the radiating region of the antenna, i.e. the open end 24 of the patch, will be on the user's shoulder so as to be further from the user's head than the curved end of the patch at connection 17.

As an alternative to using a folded layer of conducting material, the upper and lower layers, 12, 16, may be shaped separately and electrical connection established by sewing them together with electrically conductive thread, or by conductive gluing, or by sewing the conductive layers together using a seam which places them in pressurised contact.

Considering now the co-axial cable 18 and its connection to the conducting layers 12, 16, it will be understood that the location of the connection 20 along the edge of the upper conducting layer 16 is determined by the impedance of the feed line; as is well known, for lower impedance feed lines the connection should be nearer the connection between the upper and lower layers 16, 12 while for higher impedance feed lines, the connection should be further away from this connection.

An alternative to a co-axial cable 18 as a feed connection is a micro strip or strip line or twin line or tri-plate, all of which comprise layers of parallel conductors separated by a dielectric. It is therefore possible to use conducting and insulating fabric layers, similar to the fabric of the antenna, to make the feed connection. Such a connection would be joined to the conducting layers 12, 16 by conductive adhesives.

Whichever type of feed connection is used, connection to the antenna upper and lower layers 16, 12 can be made by a low temperature solder or, for improved flexibility, by use of conductive stitching, conductive glues and/or pressure bonding.

Figure 3:
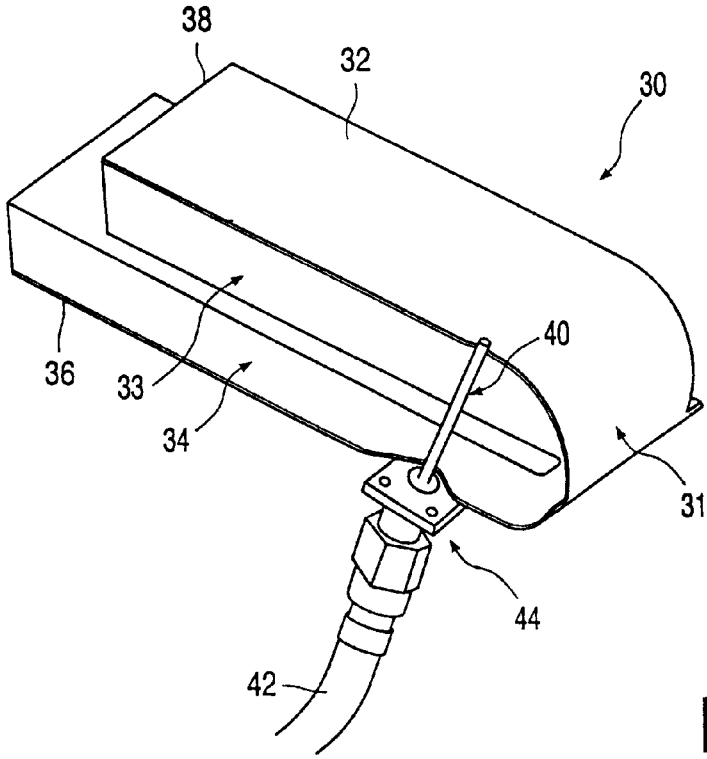
FIG. 3 illustrates a second embodiment of the present invention in the form of a lapel antenna.

FIG. 3 illustrates a lapel antenna 30 of generally rectangular shape and comprising upper and lower conducting layers 32, 36 separated by insulating layers 33, 34. The upper insulating and conducting layers 33, 32 are narrower and shorter than the lower conducting and insulating layers 36, 34. In this example the antenna is formed by a single strip of conducting fabric 31 folded round a folded layer of insulating wadding. Typically the wadding comprises a number of layers of the material known in the fashion trade as "fusible felt"; several layers of fusible felt can be joined by heating with a domestic iron to give the required thickness.

Typically the lapel antenna 30 is 100 millimeters long with the upper layers being 72 millimeters in length; the overall width is 20 millimeters with the upper layer being 16 millimeters in width. The thickness of each of the insulating layers 33, 34 is 8 millimeters in the present example. Such a patch antenna has a 3 dB band width of approximately 150 MHz and a centre frequency of around 930 MHz. Its performance is sufficient for use in a GSM mobile telephone, and it forms a quarter wavelength patch resonator.

When the patch 30 is arranged in the lapel of a user's garment, the radiating region of the antenna, i.e. the open end 38 of the patch, may be arranged to point downwards, i.e. to be further from the user's head than the folded end.

In FIG. 3, electrical connection to mobile telecommunications apparatus is made by a test probe 40 connected to the core of a co-axial test cable 42; an s.m.a. launcher flange 44 contacts the lower conducting layer 36 and the probe 40 contacts the upper conductor layer 32. Such a test probe can be used to establish impedance mismatch at positions along the side of the antenna. A permanent connection to the lapel antenna 30 can be made by a permanently fixed co-axial cable or a micro strip line or twin line etc, as with the shoulder pad antenna.

Figure 4:
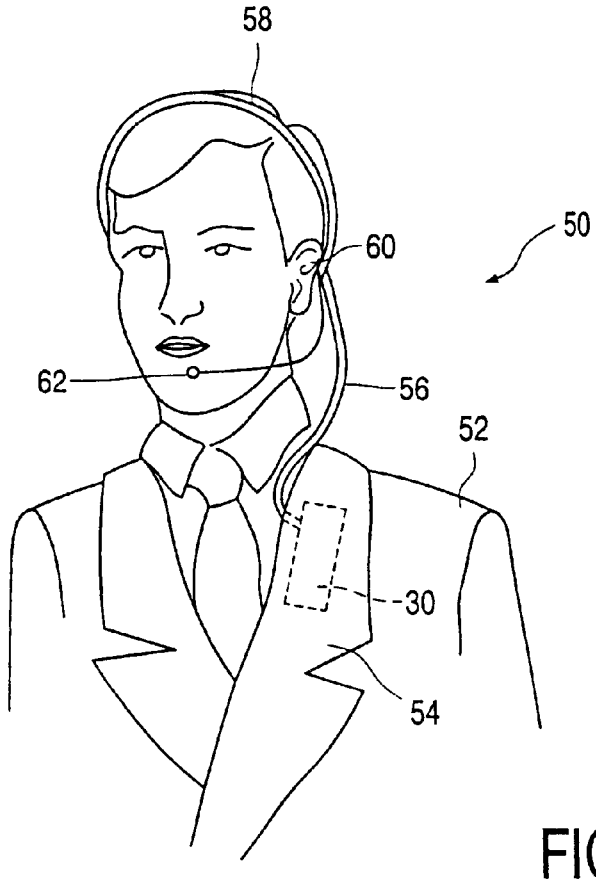
FIG. 4 illustrates a lapel antenna in use.

FIG. 4 shows a user 50 of a mobile telephone utilising an antenna according to the invention. The user 50 wears a jacket 52 having a lapel 54 within which is a lapel patch antenna 30, shown dotted. The antenna 30 is connected by a fabric twin line 56 to a lightweight headset comprising a support 58, an earpiece 60 and a microphone 62.

It will be appreciated that, in normal clothing, both a shoulder pad and a lapel are substantially thicker than other parts of a garment, so the thickness of an antenna according to the invention is easily accommodated. The positioning of the antenna on the upper part of the body is highly advantageous in that there is a much lower risk of signals being obstructed by the wearer's body.

Figure 5:
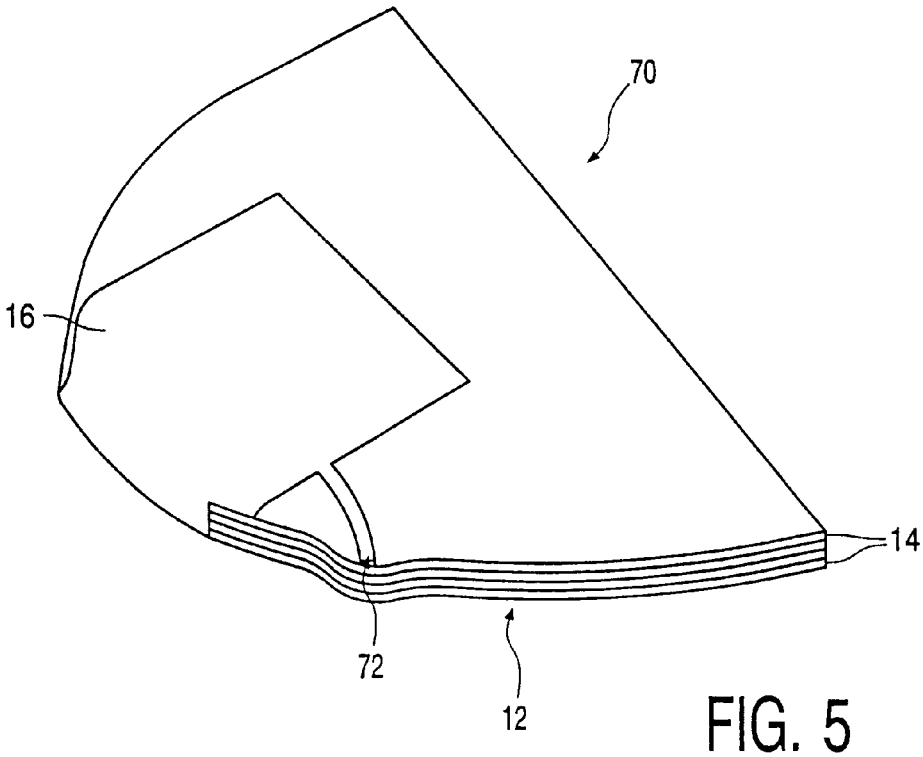
FIG. 5 illustrates the shoulder pad antenna of FIG. 1 supplied by a micro-strip feed.

As previously mentioned, the coaxial cables 18, 42 of the FIGS. 1, 2 and 3 embodiments are not the only feed options. FIG. 5 shows a modified version 70 of the shoulder pad antenna with a microstrip feed. The feed consists of a thin ribbon 72 of fabric connected to the upper conducting layer 16 and above a continuation of the grounded lower conducting layer 12.

Figure 6:
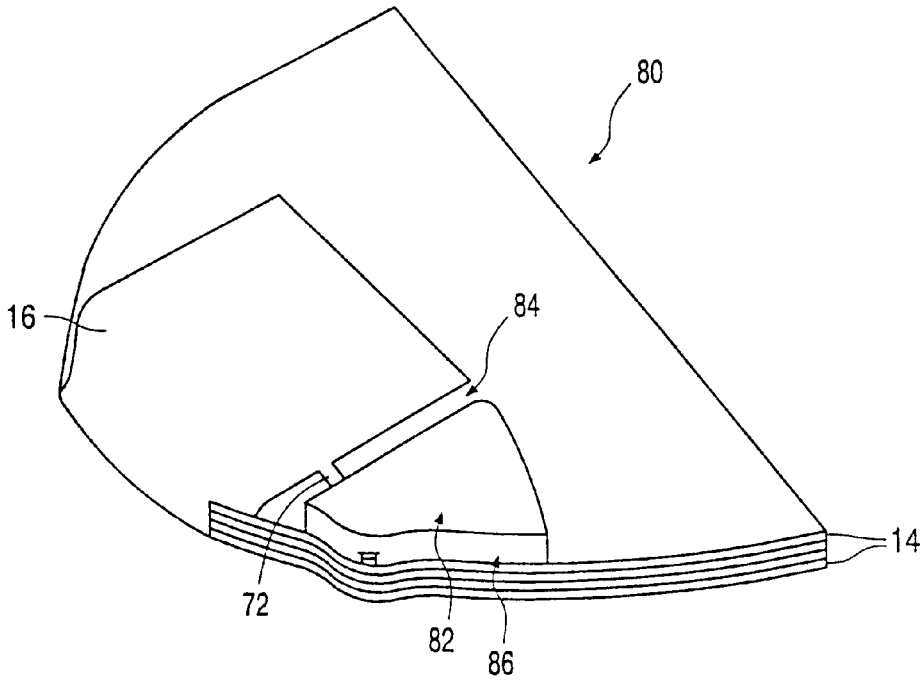
FIG. 6 illustrates the shoulder pad antenna of FIG. 1 supplied by a triplate feed.

FIG. 6 shows a further modified version 80 of the shoulder pad antenna with a triplate feed. The triplate feed is similar to the microstrip feed of FIG. 5 in having the thin ribbon 72 of fabric connected to the upper conducting layer 16. In addition there is a top layer 82 of conducting sheet fabric which, as indicated at 84, terminates before it reaches the upper patch 16. The top layer 82 is positioned above the microstrip ribbon 72 but is separated from it by a further layer of dielectric padding 86.

Any of the feeds illustrated in FIGS. 1, 2, 5 or 6 (or still further options such as a twin-line) can be used as the connection for a patch antenna to the remainder of the telecommunication system. An advantage of feeds such as the microstrip and triplate is flexibility and light weight in situations where a broad feed is required (such that coaxial cable would have unacceptable bulk and stiffness) although for lower powers the bulk of individual cable types is negligable in comparison with fabric thicknesses.

From reading the present disclosure, other modifications will be apparent to persons skilled in the art. Such modifications may involve other features which are already known in the design, manufacture and use of fabric antennas and applications thereof and which may be used instead of or in addition to features already described herein.

What is claimed is:

1. An antenna for mobile telecommunications use and comprising first and second spaced layers of electrically conducting flexible fabric; a layer of electrically insulating flexible fabric between the first and second layers; first connection means by which electrical contact is made between said first and second layers; and second connection means by which said first and second layers are connectable to telecommunications equipment.

2. An antenna according to claim 1 shaped for incorporation into a shoulder pad of a garment.

3. An antenna according to claim 1 shaped for incorporation into a lapel of a garment.

4. An antenna according to claim 2, wherein the layer of electrically conducting flexible fabric adjacent a wearer of the garment is of substantially greater area than the other layer of electrically conducting flexible fabric and is connected as the antenna ground plane.

5. An antenna according to claim 2, wherein the radiating region of the antenna is arranged in the wearer's garment to be remote from the wearer's head.

6. An antenna according to claim 1, comprising a single piece of electrically conducting flexible fabric folded around a layer of insulating flexible fabric, said fold comprising the first connection means.

7. An antenna according to claim 1, wherein the layer of insulating flexible fabric comprises multiple layers of the same or different insulating flexible fabrics.

8. An antenna according to claim 1, wherein the second connection means comprises at least one layer of conducting flexible fabric and at least one layer of insulating flexible fabric arranged as one from the group comprising a micro strip, a strip line, a twin line, and a tri plate.

9. A mobile telecommunications system comprising a transmitter, a receiver and characterised by a patch antenna according to claim 1.

* * * * *